US008118694B1

(12) United States Patent
Oliveira

(10) Patent No.: US 8,118,694 B1
(45) Date of Patent: Feb. 21, 2012

(54) ARROW TIP WITH DRIVEN DEPLOYABLE RETRACTABLE BLADE MEMBERS

(76) Inventor: Luiz C. Oliveira, West Tisbury, MA (US)

( * ) Notice: Subject to any disclaimer, the term of this patent is extended or adjusted under 35 U.S.C. 154(b) by 0 days.

(21) Appl. No.: 12/907,175

(22) Filed: Oct. 19, 2010

(51) Int. Cl.
*F42B 6/08* (2006.01)

(52) U.S. Cl. ..... 473/583

(58) Field of Classification Search ..... 473/578, 473/582, 583, 584
See application file for complete search history.

(56) References Cited

U.S. PATENT DOCUMENTS 2,859,970 A * 11/1958 Doonan ..... 473/583
7,717,814 B1 * 5/2010 Sanford ..... 473/583
7,780,554 B1 * 8/2010 Sanford ..... 473/583
7,905,802 B2 * 3/2011 Erhard ..... 473/583
* cited by examiner

*Primary Examiner* — John Ricci
(74) *Attorney, Agent, or Firm* — Michael I. Kroll

(57) ABSTRACT

An arrow with retractable blades having an arrow shaft with a cylindrical extension extending from a forward end, an arrow tip having a main body with an open rear end, an arrow shaft recess and a cylinder recess sized to receive the cylindrical extension. The main body includes a plurality of longitudinal blade slots with a blade pivotally affixed within each blade slot, with each blade jointly pivotable between a closed position and a deployed position, with a spring within the arrow shaft recess biasing the forward end of said arrow shaft normally rearward. Spaced circumferential ridges on the cylindrical extension engage mating teeth on each blade such that forward motion of the cylindrical extension within the cylinder recess pivots the blades into the deployed position and rearward motion of the cylindrical extension pivots the blades into the closed position, with a threaded cap over the open rear end of the main body maintaining the forward end of the arrow shaft within the arrow shaft recess.

20 Claims, 8 Drawing Sheets

ARROW TIP WITH DRIVEN DEPLOYABLE RETRACTABLE BLADE MEMBERS

BACKGROUND OF THE INVENTION

1. Field of the Invention

The present invention relates generally to archery and, more specifically, to a broadhead or other style arrow tip having retractable blades that deploy upon impact with a target and having a main body with retractable/deployable razor sharp blades pivotally attached and set to deploy to a desired angular position.

When the arrow tip impacts its target, the forward end of the arrow shaft is forced forward by the arrow's kinetic energy, compressing a variable tension spring and deploying the blades to a predetermined angle, such as 35 to 40 degrees. When the arrow tip is removed from its target, the spring biases the blades back into the main body.

2. Description of the Prior Art

There are other arrow tips designed for archery. While these arrow tips may be suitable for the purposes for which they where designed, they would not be as suitable for the purposes of the present invention as heretofore described.

It is thus desirable to provide an arrow tip having means for deploying and retracting blade members.

It is further desirable to provide an arrow tip that deploys blade members to desired angular positions upon impact with a target and to retract the blade members when the arrow tip is pulled and removed from the target.

SUMMARY OF THE PRESENT INVENTION

A primary object of the present invention is to provide a broadhead or other style arrow tip having means for deploying blade members to a desired angular relationship upon contact with a target and means for retracting said blade members when disengaged and pulled from said target.

Another object of the present invention is to provide a broadhead or other style arrow tip having a main body with the deployable retractable blade members pivotally attached by set screws.

Yet another object of the present invention is to provide a broadhead or other style arrow tip having blade members with a plurality of teeth matable with circumferential ridges on a cylindrical extension extending from a forward end of the arrow shaft for driving the blade members into either a deployed or seated position.

Still yet another object of the present invention is to provide a broadhead or other style arrow tip having a spring for normally biasing the deployed blade members to their retracted position.

Additional objects of the present invention will appear as the description proceeds.

The present invention overcomes the shortcomings of the prior art by providing a broadhead or other style arrow tip having retractable blades that deploy upon impact with a target and having a main body with the retractable/deployable razor sharp blades pivotally attached and angularly set by set screws. When the arrow head impacts its target, the cylindrical extension at the forward end of the arrow shaft is forced forward by the arrows kinetic energy, compressing the spring and deploying the blades to a preset angle such as 35 to 40 degrees. When the arrow tip is removed from its target, the spring biases the blades to retract back into the main body.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
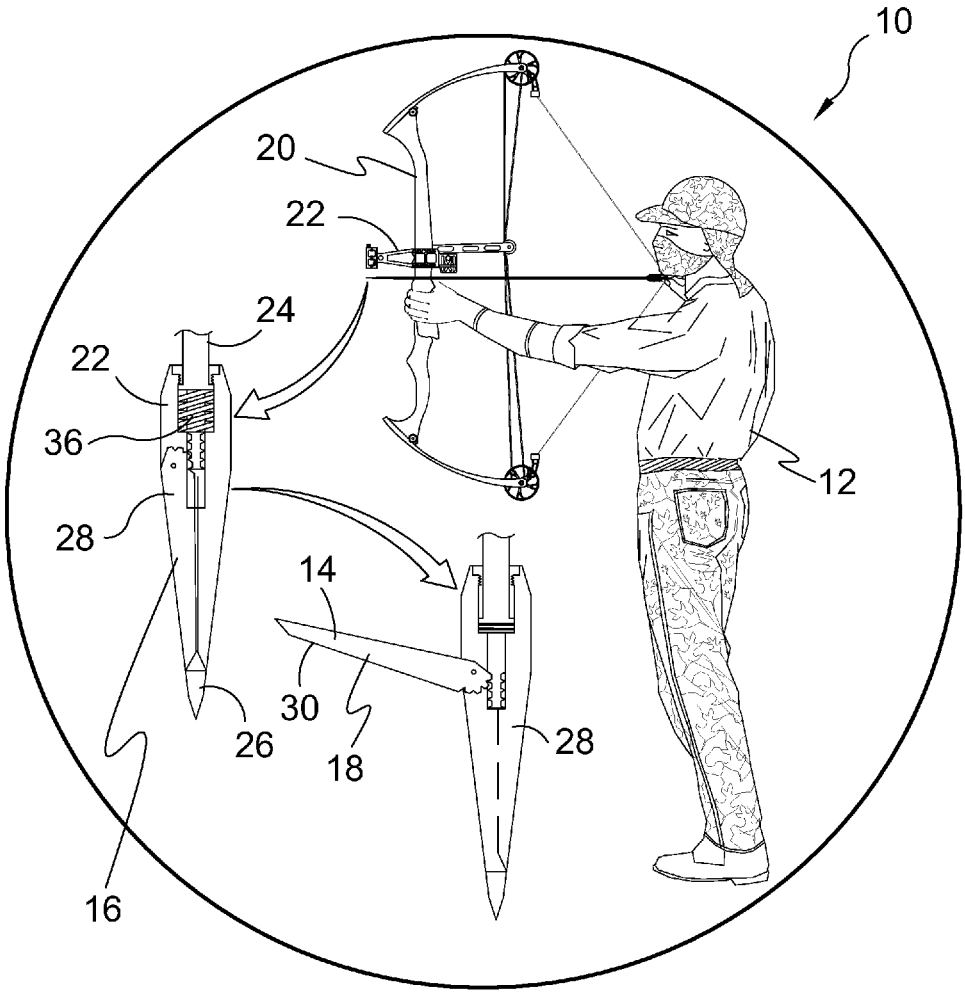
FIG. 1 is an illustrative view of the arrow tip of the present invention.

Turning now descriptively to the drawing figures, in which similar reference characters denote similar elements throughout the several views, the figures illustrate the Arrow Tip With Driven Deployable Retractable Blade Member of the present invention. With regard to the reference numerals used, the following numbering is used throughout the various drawing figures.

10 Arrow Tip of the present invention
12 hunter
14 blades
16 closed position
18 deployed position
20 bow
22 arrow
24 arrow shaft
26 forward end of 24
28 main body of 10
30 edged portion of 14
32 biasing means
34 engagement means
36 retaining means
38 prior art arrow tip
40 spring
42 cylindrical extension
44 rear end of 28
46 arrow shaft recess
48 cylinder recess
50 threaded cap
52 threads on 44
54 flange on 26

56 longitudinal blade slots
58 distal free end of 14
60 pivotally connected end of 14
62 circumferential ridges on 42
64 mating teeth on 60
66 threaded aperture in 60
68 set screw
70 stainless steel tip

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the arrow tip of the present invention, a generally broadhead arrow tip 10 of the type commonly used by a bow hunter 12 during hunting season. The invention provides a broadhead arrow tip 10 having blades 14 normally biased into a retracted, or closed position 16. Upon impact with a target, the blades 14 are pivoted into a deployed position 18. Shown is a hunter 12 employing a bow 20 with a nocked and drawn arrow 22 ready for release toward a target. The arrow 22 includes an arrow shaft 24 having a forward end 26 and a number of blades 14 pivotally affixed and jointly pivotable between a closed position 16 with the blades 14 retained substantially within the main body 28 of the arrow tip 10 and a deployed position 18 with the blades 14 extended. In the closed position 16, the arrow tip 10 is much easier and safer to handle and transport, as no sharp edged portions 30 of the blades 14 are exposed prior to target impact. A biasing means 32 within the main body 28 of the arrow tip 10 biases the forward end 26 of the arrow shaft 24 normally rearward, while engagement means 34 couples the forward end 26 of the shaft 24 to the blades 14 such that forward motion of the shaft 24 acts to pivot the blades 14 from the closed position 16, wherein the edged portions 30 of each blade 14 are fully retained within the main body 28 of the arrow tip 10, into the deployed position 18, with the blades 14 extending outwardly from the main body 28 of the arrow tip 10. Subsequent rearward motion of the arrow shaft 24 pivots the blades 14 back into the closed position 16. Retaining means 36 maintains and secures the forward end 26 of the arrow shaft 24 to the arrow tip 10.

Figure 2:
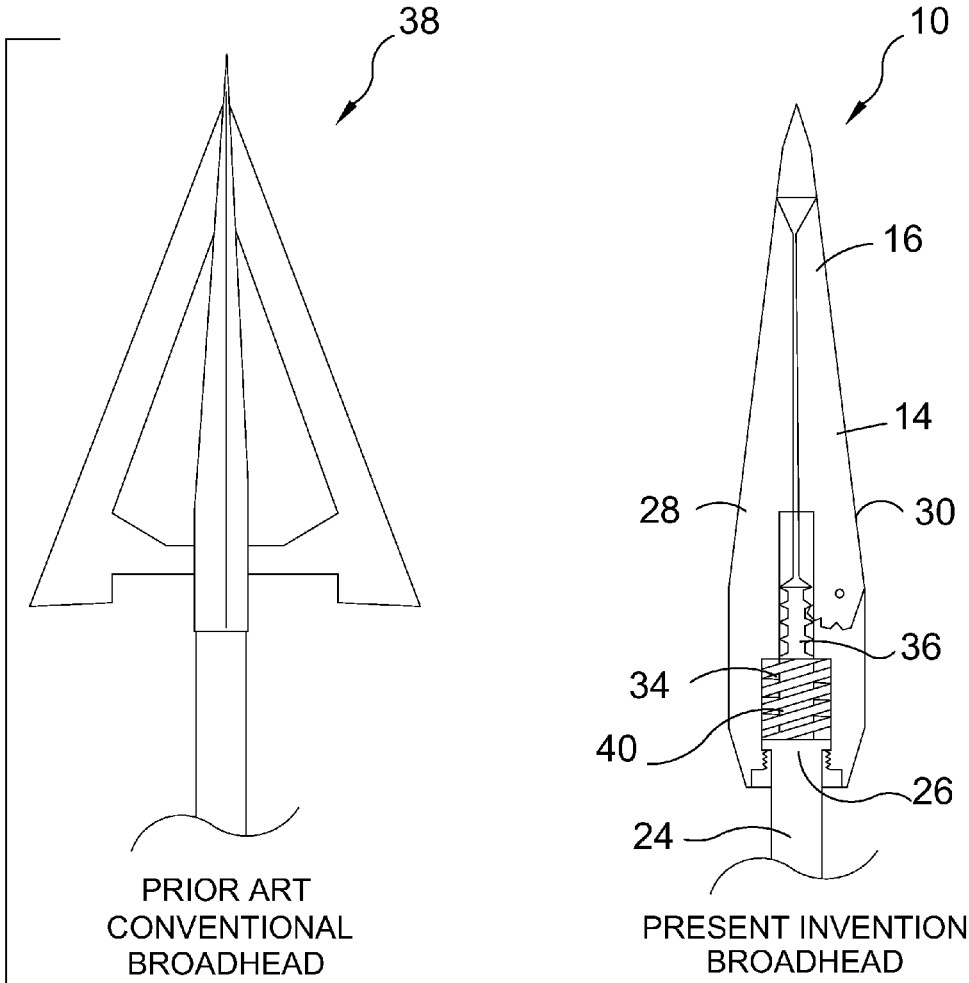
FIG. 2 is an illustrative view of the prior art and the present invention.

FIG. 2 is an illustrative view of the prior art arrow tip 38 and the arrow tip 10 of the present invention. An extremely important tool of bow hunting is the arrow head, or tip. It is the arrow head that absorbs the energy from the bow string and carries the razor sharp broadhead toward the intended target. There are a number of different types of broadhead arrows available on the market, each type has a certain shape that allows it to perform a particular function, and all having dangerous razor sharp blades. The present invention overcomes the hazards and inconveniencies of handling, storing and transporting the prior art arrow tips 38 by providing a broadhead arrow tip 10 adaptable to be produced in any shape and having retractable blades 14 that are normally biased into a closed position 16, wherein the edged portions 30 of each blade 14 are fully retained within the main body 28 of the arrow tip 10, only deploy upon impact with a target. The design provides safety to the user by having no sharp exposed cutting blades prior to impact while still providing bone shattering capabilities.

The engagement means 34 is preferably a mechanical linkage operatively connecting the forward end 26 of the arrow shaft 24 to a plurality of blades 14 pivotally affixed to the main body 28 of the arrow tip 10, each the blades 14 jointly pivotable and normally biased into a closed position 16 with the blades 14 retained substantially within the main body 28 of the arrow tip 10. The biasing means is preferably a spring 40. Retaining means 36 maintains and secures the forward end 26 of the arrow shaft 24 to the arrow tip 10.

Figure 3:
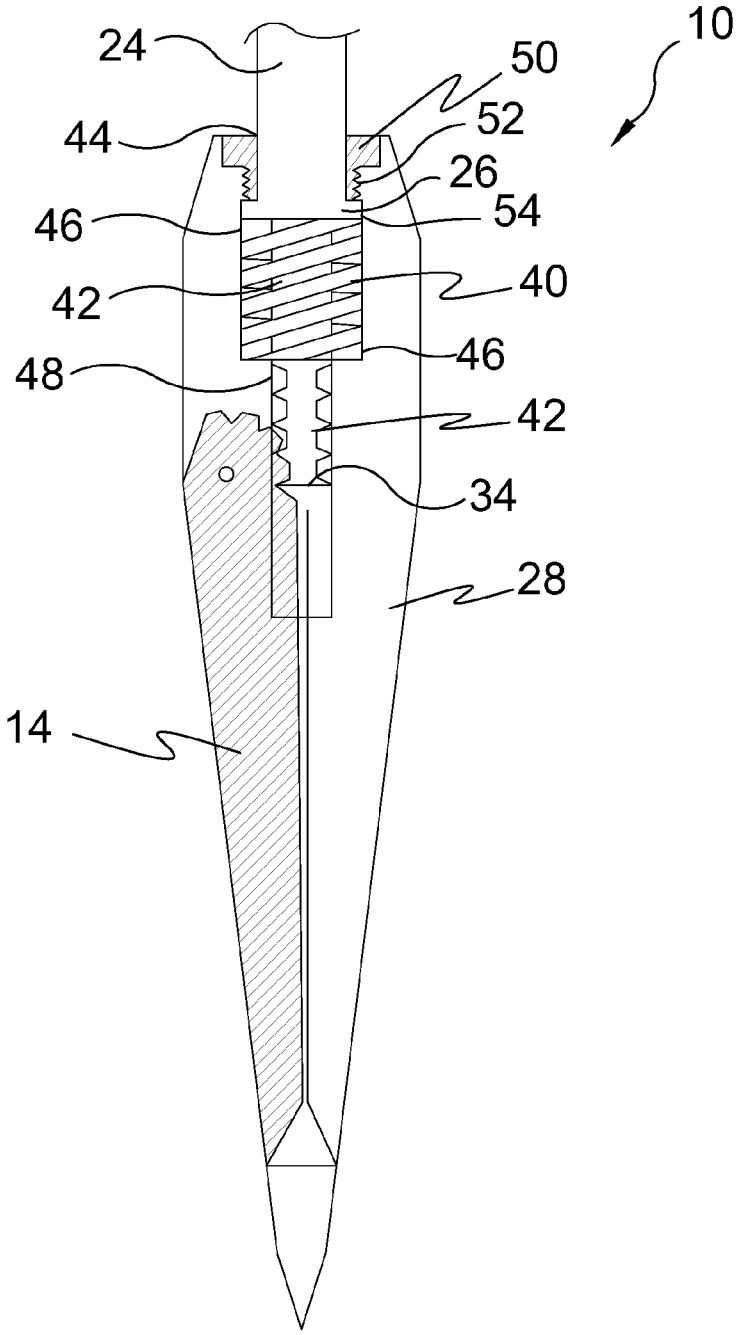
FIG. 3 is a sectional view the arrow tip of the present invention.

FIG. 3 is a sectional view the arrow tip 10 of the present invention. The present invention provides a retractable blade arrow tip 10 having an arrow shaft 24 with a forward end 26 and a cylindrical extension 42 extending from the forward end 26. The arrow tip 10 is formed of a main body 28 portion with an open rear end 44, the rear end 44 having an arrow shaft recess 46 sized to receive the forward end 26 of the arrow shaft 24 and a cylinder recess 48 sized and positioned to receive the cylindrical extension 42 when the forward end 26 of the arrow shaft 24 is received within the arrow shaft recess 46, with the cylindrical extension 42 having a defined range of longitudinally movement within the cylinder recess 48. A plurality of blades 14 are pivotally affixed to the main body 28 of the arrow tip 10, with each blade jointly pivotable between a closed position with the blades 14 retained substantially within the main body 28 and a deployed position with the blades 14 extending outwardly from the main body 28. A biasing means, for example, a spring 40 within the arrow shaft recess 46 biases the forward end 26 of the arrow shaft 24 normally rearward, and engagement means 34 between the cylindrical extension 42 and the blades 14 transfers forward motion of the cylindrical extension 42 within the cylinder recess 48 into pivoting motion of the blades 14 into the deployed position and rearward motion of the cylindrical extension 42 within the cylinder recess 48 into pivoting motion of the blades 14 into the closed position 16. Preferably, a threaded cap 50 secures over the open rear end 44 of the main body 28 of the arrow tip 10, with the open rear end 44 having threads 52 mateable with the threaded cap 50 as retaining means for maintaining the forward end 26 of the arrow shaft 24 within the arrow shaft recess 46. Also shown is a flange 54 on the forward end 26 of the arrow shaft 24, the flange 54 sized to fit within the arrow shaft recess 46 and larger than the cylinder recess 48.

Figure 4:
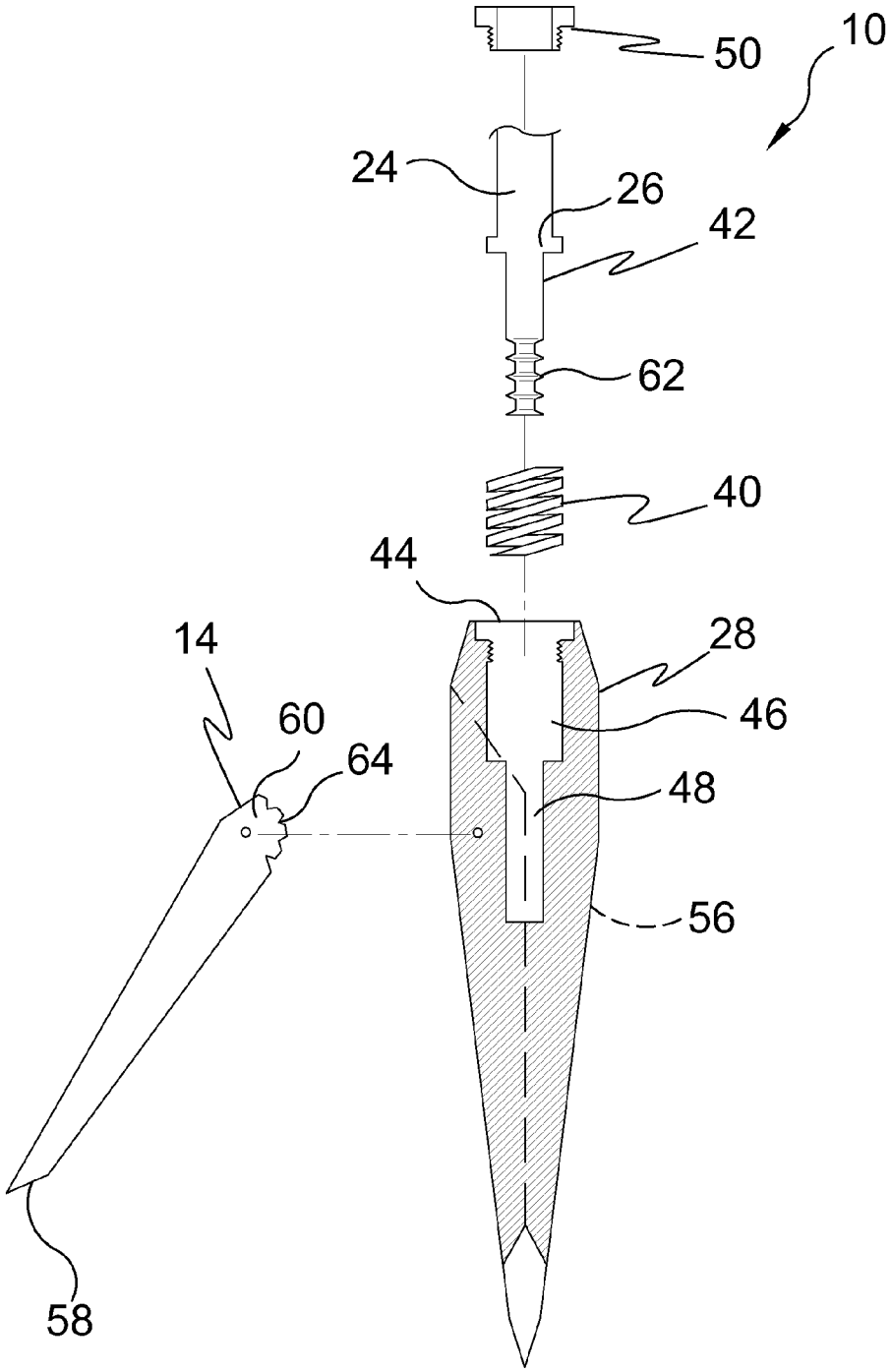
FIG. 4 is an exploded sectional view of the present invention.

FIG. 4 is an exploded sectional view of the present invention. Shown are the components of the broadhead arrow tip 10 of the present invention. When the arrow tip 10 impacts its target, the cylindrical extension 42 is forced forward by the arrow shaft's 24 kinetic energy, compressing the spring 40 and deploying the blades 14 to an adjustable angle, such as 35 to 40 degrees. When the arrow tip 10 is removed from its target, the blades 14 retract back to the main body 28 of the arrow tip 10.

The arrow shaft 24 has a forward end 26 with a cylindrical extension 42 extending from the forward end 26, while the arrow tip 10 has a main body 28 with an open rear end 44, the rear end 44 having an arrow shaft recess 46 sized to receive the forward end 26 of the arrow shaft 24 and a cylinder recess 48 sized and positioned to receive the cylindrical extension 42 when the forward end 26 of the arrow shaft 24 is received within the arrow shaft recess 46, with the cylindrical extension 42 having a defined range of longitudinally movement within the cylinder recess 48. The main body 28 includes a plurality of longitudinal blade slots 56 with a blade 14 pivotally affixed within each of the plurality of blade slots 56, each blade 14 jointly pivotable between a closed position with the blades 14 retained substantially within the main body 28 and a deployed position with the blades extending outwardly from the main body 28. Preferably, a spring 40 acts as biasing means within the arrow shaft recess 46 for biasing the forward end 26 of the arrow shaft 24 normally rearward. Generally, each blade 14 will include a distal free end 58 and an oppositely disposed pivotally connected end 60, with the pivotally connected end 60 engaged with the cylindrical extension 42, for example, through a plurality of spaced circumferential ridges 62 on the cylindrical extension 42 which engage a plurality of mating teeth 64 on the pivotally connected end 60 of each blade 14. Optionally, each blade 14 is individually removable. The engagement between the cylindrical extension 42 and the pivotally connected end 60 of the blades 14 is such that forward motion of the cylindrical extension 42 within the cylinder recess 48 pivots the blades 14 into the deployed position and rearward motion of the cylindrical extension 42 within the cylinder recess 48 pivots the blades into the closed position. A threaded cap 50 acts as retaining means for maintaining the forward end 26 of the arrow shaft 24 within the arrow shaft recess 46.

Also shown is a flange 54 on the forward end 26 of the arrow shaft 24, the flange 54 sized to fit within the arrow shaft recess 46 and larger than the cylinder recess 48. The blades 14 are secured to the main body 28 of the arrow tip 10, for example, by a set screw 66 threaded through an aperture 68 in the pivotally connected end 60 of each blade 14. Each blade preferably includes an edged portion 30 which is fully retained within the main body 28 of the arrow tip 10 when the blades 14 are in the closed position. The main body 28 is formed of stainless steel, as are the blades 14. The cylindrical extension 42, which extends from the forward end 26 of the arrow shaft 24 can be removably affixed to the forward end 26, or can optionally be integral with or permanently affixed to, the forward end 26 of the arrow shaft 24. The spring 40 is optionally a variable tension spring.

Figure 5:
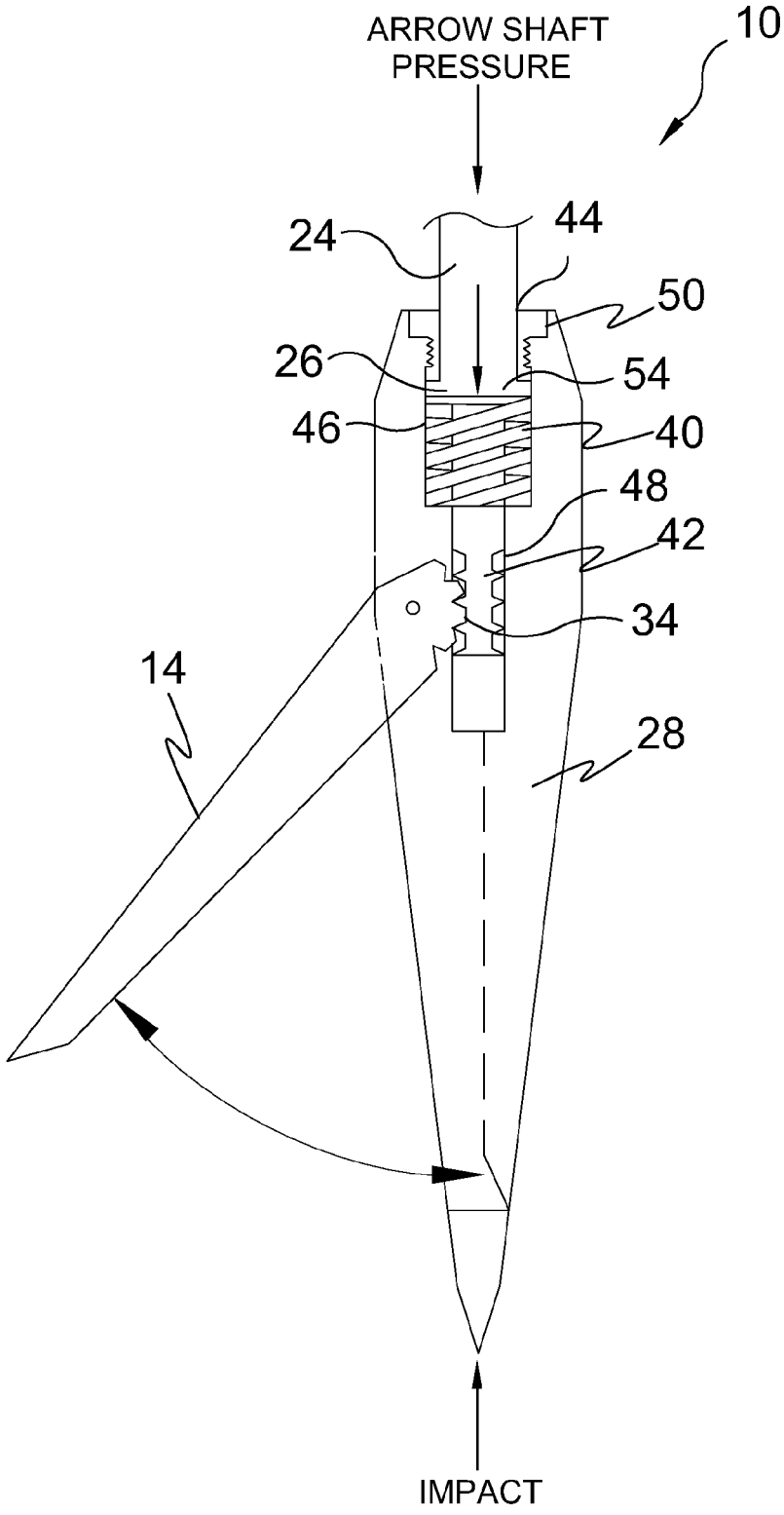
FIG. 5 is a sectional view of the present invention.

FIG. 5 is a sectional view of the present invention. Shown is the arrow tip 10 of the present invention partially deployed, i.e., just after the arrow tip 10 impacts the target, and the kinetic energy of the arrow shaft 24 forces the cylindrical extension 42 forward, compressing the spring 40 and deploying the blades 14 outward from the main body 28. When the arrow tip 10 is subsequently removed from its target, the blades 14 retract back to the main body 28 of the arrow tip 10.

Shown is the retractable blade arrow tip 10 having an arrow shaft 24 with a forward end 26 and a cylindrical extension 42 extending from the forward end 26. The arrow tip 10 is formed of a main body 28 portion with an open rear end 44, the rear end 44 having an arrow shaft recess 46 sized to receive the forward end 26 of the arrow shaft 24 and a cylinder recess 48 sized and positioned to receive the cylindrical extension 42 when the forward end 26 of the arrow shaft 24 is received within the arrow shaft recess 46, with the cylindrical extension 42 having a defined range of longitudinally movement within the cylinder recess 48. A plurality of blades 14 are pivotally affixed to the main body 28 of the arrow tip 10, with each blade jointly pivotable between a closed position with the blades 14 retained substantially within the main body 28 and a deployed position with the blades 14 extending outwardly from the main body 28. A biasing means, for example, a spring 40 within the arrow shaft recess 46 biases the forward end 26 of the arrow shaft 24 normally rearward, and engagement means 34 between the cylindrical extension 42 and the blades 14 transfers forward motion of the cylindrical extension 42 within the cylinder recess 48 into pivoting motion of the blades 14 into the deployed position and rearward motion of the cylindrical extension 42 within the cylinder recess 48 into pivoting motion of the blades 14 into the closed position 16. Preferably, a cap 50 secures over the open rear end 44 of the main body 28 of the arrow tip 10, as retaining means for maintaining the forward end 26 of the arrow shaft 24 within the arrow shaft recess 46. Also shown is a flange 54 on the forward end 26 of the arrow shaft 24, the flange 54 sized to fit within the arrow shaft recess 46 and larger than the cylinder recess 48.

Figure 6:
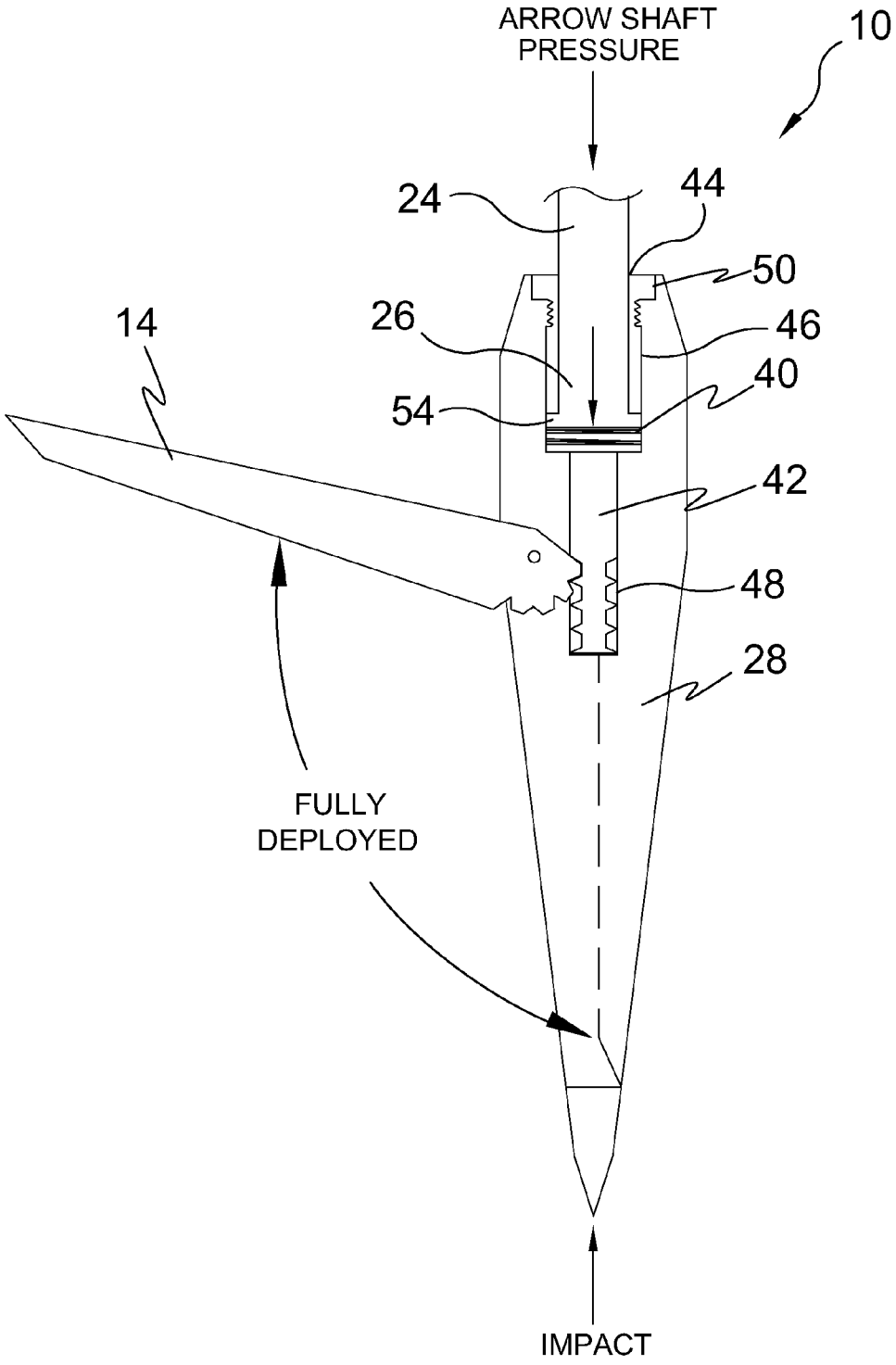
FIG. 6 is a sectional view of the present invention.

FIG. 6 is a sectional view of the present invention. Shown is the present invention in a fully deployed position having the blades 14 extended to a preselected angle. When the arrow tip 10 impacts its target, the cylindrical extension 42 is forced forward by the arrow shaft's 24 kinetic energy, compressing the spring 40 and deploying the blades 14 to an adjustable angle, such as 35 to 40 degrees. When the arrow tip 10 is removed from its target, the blades 14 retract back to the main body 28 of the arrow tip 10.

Shown is the retractable blade arrow tip 10 having an arrow shaft 24 with a forward end 26 and a cylindrical extension 42 extending from the forward end 26. The arrow tip 10 is formed of a main body 28 portion with an open rear end 44, the rear end 44 having an arrow shaft recess 46 sized to receive the forward end 26 of the arrow shaft 24 and a cylinder recess 48 sized and positioned to receive the cylindrical extension 42 when the forward end 26 of the arrow shaft 24 is received within the arrow shaft recess 46, with the cylindrical extension 42 having a defined range of longitudinally movement within the cylinder recess 48. A plurality of blades 14 are pivotally affixed to the main body 28 of the arrow tip 10, with each blade jointly pivotable between a closed position with the blades 14 retained substantially within the main body 28 and a deployed position with the blades 14 extending outwardly from the main body 28. A biasing means, for example, a spring 40 within the arrow shaft recess 46 biases the forward end 26 of the arrow shaft 24 normally rearward, and engagement means 34 between the cylindrical extension 42 and the blades 14 transfers forward motion of the cylindrical extension 42 within the cylinder recess 48 into pivoting motion of the blades 14 into the deployed position and rearward motion of the cylindrical extension 42 within the cylinder recess 48 into pivoting motion of the blades 14 into the closed position. Preferably, a cap 50 secures over the open rear end 44 of the main body 28 of the arrow tip 10, as retaining means for maintaining the forward end 26 of the arrow shaft 24 within the arrow shaft recess 46. Also shown is a flange 54 on the forward end 26 of the arrow shaft 24, the flange 54 sized to fit within the arrow shaft recess 46 and larger than the cylinder recess 48.

Figure 7:
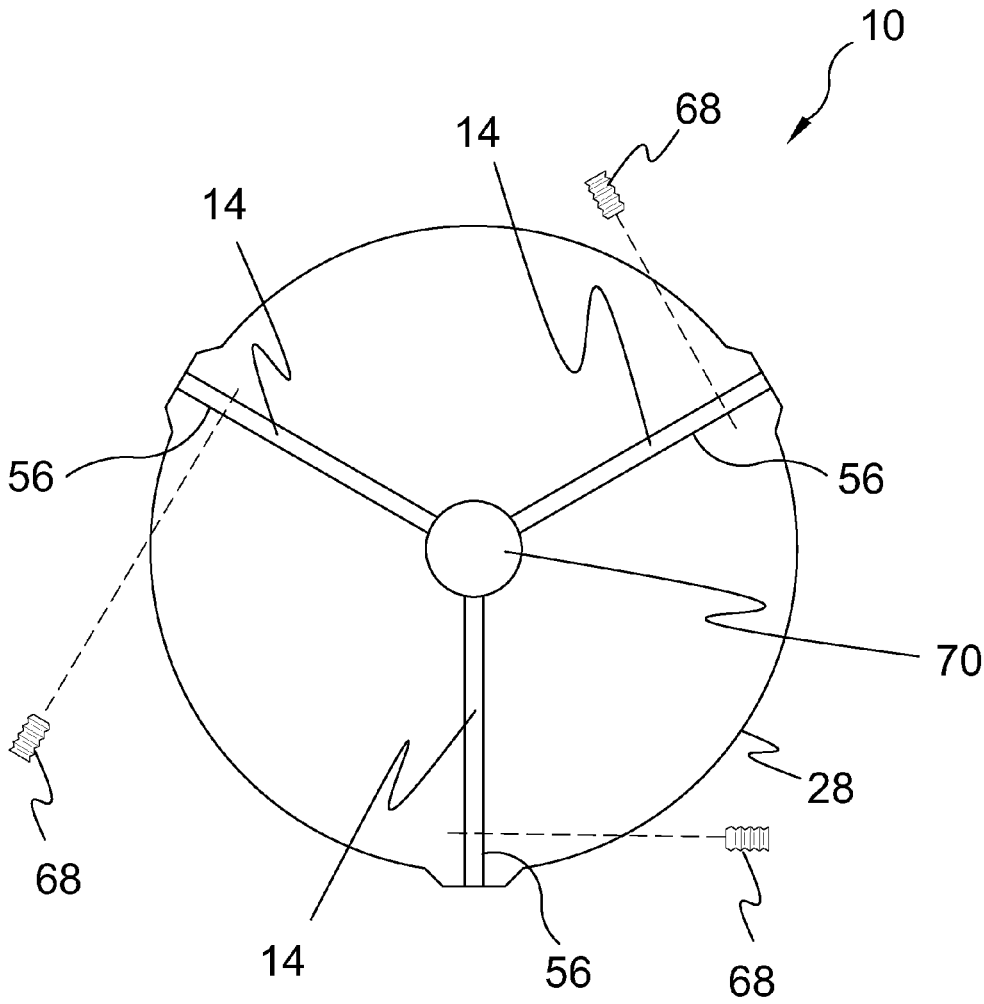
FIG. 7 is a top view the present invention with blades retracted.

FIG. 7 is a top view the present invention with blades retracted. Shown is a top view of the present invention, a retractable blade arrow tip 10 having a main body 28 portion with a plurality of longitudinal blade slots 56 for retaining retractable blades 14 surrounding a stainless steel tip 70. Also shown is a plurality of set screws 68 for securing the blades to the main body 28 of the arrow tip 10.

Figure 8:
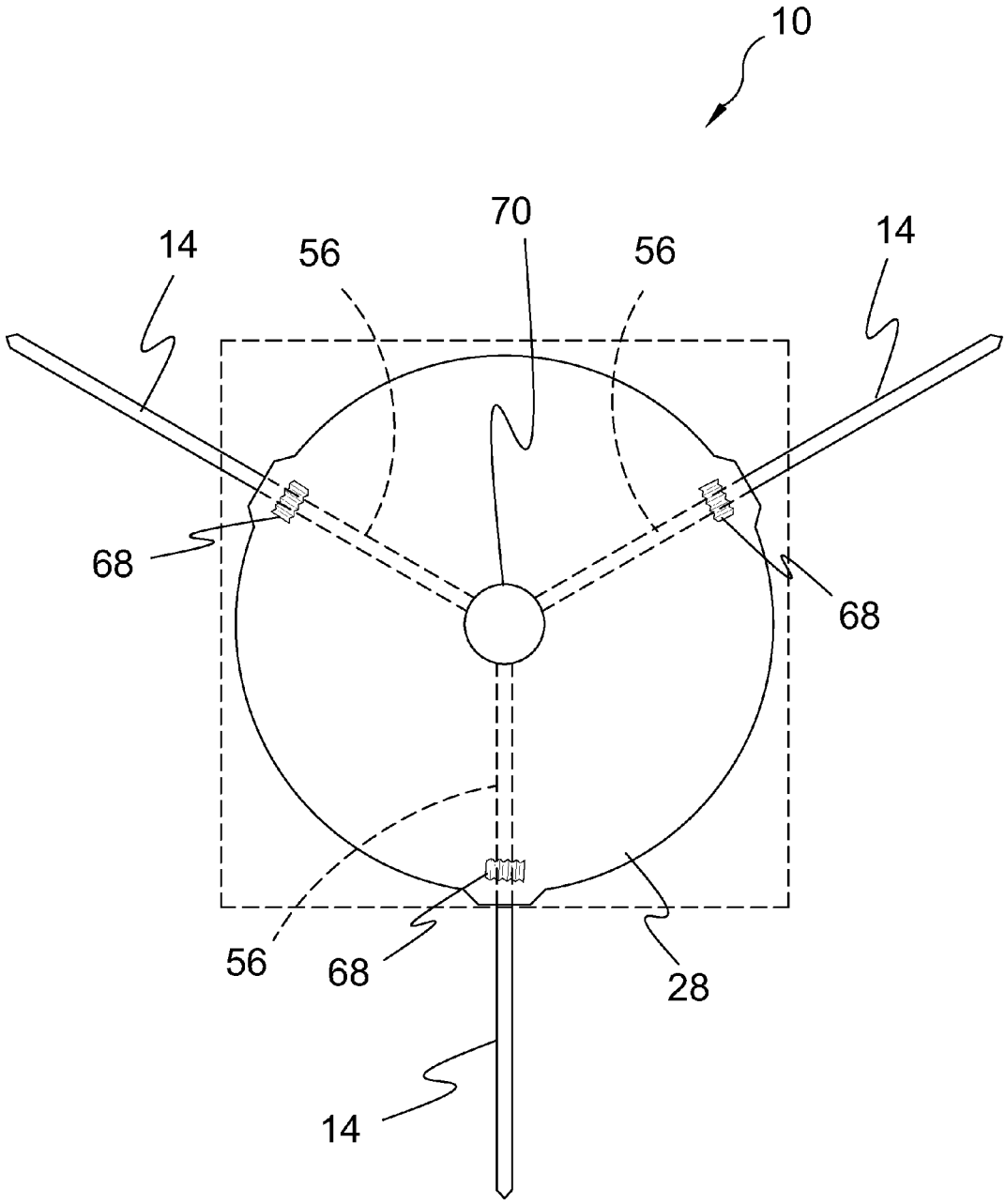
FIG. 8 is a top view the present invention with blades deployed.

FIG. 8 is a top view the present invention with blades deployed. Shown is a top view of the present invention, a retractable blade arrow tip 10 having a main body 28 portion with a plurality of longitudinal blade slots 56 for retaining retractable blades 14 surrounding a stainless steel tip 70. Also shown is a plurality of set screws 68 for securing the blades to the main body 28 of the arrow tip 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An arrow having retractable arrow tip blades comprising:

a) an arrow shaft having a forward end with a cylindrical extension extending from said forward end;

b) an arrow tip having a main body with an open rear end, said rear end having an arrow shaft recess sized to receive said forward end of said arrow shaft and a cylinder recess sized and positioned to receive said cylindrical extension when said forward end of said arrow shaft is received within said arrow shaft recess, with said cylindrical extension having a defined range of longitudinally movement within said cylinder recess, said main body including a plurality of longitudinal blade slots with a blade pivotally affixed within each of said plurality of blade slots, each said blade jointly pivotable between a closed position with said blades retained substantially within said main body and a deployed position with said blades extending outwardly from said main body;

c) biasing means within said arrow shaft recess for biasing said forward end of said arrow shaft rearward;

d) engagement means between said cylindrical extension and said blades such that forward motion of said cylindrical extension within said cylinder recess pivots said blades into said deployed position and rearward motion of said cylindrical extension within said cylinder recess pivots said blades into said closed position; and e) retaining means for maintaining said forward end of said arrow shaft within said arrow shaft recess.

2. The arrow according to claim 1, wherein each said blade comprises a distal free end and an oppositely disposed pivotally connected end.

3. The arrow according to claim 2, wherein said engagement means comprises a plurality of spaced circumferential ridges on said cylindrical extension and a plurality of mating teeth on said pivotally connected end of each said blade.

4. The arrow according to claim 3, wherein each said blade is individually removable.

5. The arrow according to claim 4, further comprising:

a) a threaded aperture in said pivotally connected end of each said blade; and b) a set screw sized to engage each said threaded aperture.

6. The arrow according to claim 1, wherein each said blade comprises an edged portion which is fully retained within said main body when said blades are in said closed position.

7. The arrow according to claim 1, further comprising a flange on said forward end of said arrow shaft, said flange sized to fit within said arrow shaft recess and larger than said cylinder recess.

8. The arrow according to claim 1, wherein said biasing means comprises a spring.

9. The arrow according to claim 8, wherein said spring is a variable tension spring.

10. The arrow according to claim 1, wherein each said retaining means comprises a threaded cap over said open rear end of said main body, with said open rear end having threads mateable with said cap threads.

11. The arrow according to claim 1, wherein said cylindrical extension is removably affixed to said forward end of said arrow shaft.

12. The arrow according to claim 1, wherein said cylindrical extension is integral with said forward end of said arrow shaft.

13. The arrow according to claim 1, wherein said blades, when in said deployed position, extend outwardly from said main body at a user-adjustable angle.

14. The arrow according to claim 1, wherein said blades, when in said deployed position, extend outwardly from said main body at an angle between about 35 degrees and 40 degrees.

15. An arrow having retractable arrow tip blades comprising:

a) an arrow shaft having a flange at a forward end and a cylindrical extension extending from said forward end of said arrow shaft;

b) an arrow tip having a main body with an open rear end, said rear end having an arrow shaft recess sized to receive said forward end of said arrow shaft and a cylinder recess sized and positioned to receive said cylindrical extension when said forward end of said arrow shaft is received within said arrow shaft recess, with said flange sized to fit within said arrow shaft recess and larger than said cylinder recess, said cylindrical extension having a defined range of longitudinally movement within said cylinder recess, said main body including a plurality of longitudinal blade slots with a blade pivotally affixed within each of said plurality of blade slots, each said blade jointly pivotable between a closed position with said blades retained substantially within said main body and a deployed position with said blades extending outwardly from said main body, each said blade having a distal free end, an oppositely disposed pivotally connected end, and an edged portion which is fully retained within said main body when said blades are in said closed position;

c) a spring within said arrow shaft recess for biasing said forward end of said arrow shaft rearward;

d) engagement means between said cylindrical extension and said blades such that forward motion of said cylindrical extension within said cylinder recess pivots said blades into said deployed position and rearward motion of said cylindrical extension within said cylinder pivots said blades into said closed position, said engagement means being a plurality of spaced circumferential ridges on said cylindrical extension and a plurality of mating teeth on said pivotally connected end of each said blade; and e) threaded cap over said open rear end of said main body, with said open rear end having threads mateable with said cap threads for maintaining said forward end of said arrow shaft within said arrow shaft recess.

16. The arrow according to claim 15, wherein said blades, when in said deployed position, extend outwardly from said main body at an angle between about 35 degrees and 40 degrees.

17. The arrow according to claim 16, further comprising:

a) a threaded aperture in said pivotally connected end of each said blade; and b) a set screw sized to engage each said threaded aperture.

18. The arrow according to claim 17, wherein said cylindrical extension is integral with said forward end of said arrow shaft.

19. The arrow according to claim 17, wherein said cylindrical extension is removably affixed to said forward end of said arrow shaft.

20. The arrow according to claim 18, wherein said main body is formed of stainless steel.

* * * * *